US010470502B2

(12) United States Patent
Rosati et al.

(10) Patent No.: US 10,470,502 B2
(45) Date of Patent: Nov. 12, 2019

(54) SURGICAL HELMET

(75) Inventors: Giorgio Rosati, San Cesareo (IT); Marco Vagliviello, Klagenfurt am Wörthersee (AT); Franz Kogler, Klagenfurt am Wörthersee (AT); Stefan Tripolt, Klagenfurt am Wörthersee (AT)

(73) Assignee: THI TOTAL HEALTHCARE INNOVATION GMBH, Feistritz Im Rosental (AT)

( * ) Notice: Subject to any disclaimer, the term of this patent is extended or adjusted under 35 U.S.C. 154(b) by 718 days.

(21) Appl. No.: 13/984,908

(22) PCT Filed: Feb. 14, 2011

(86) PCT No.: PCT/IT2011/000036

§ 371 (c)(1),
(2), (4) Date: Sep. 3, 2014

(87) PCT Pub. No.: WO2012/111030

PCT Pub. Date: Aug. 23, 2012

(65) Prior Publication Data

US 2015/0082522 A1 Mar. 26, 2015

(51) Int. Cl.

| | |
|---|---|
| ***A41D 13/002*** | (2006.01) |
| ***A42B 3/28*** | (2006.01) |
| ***A41D 13/11*** | (2006.01) |
| ***A42B 3/04*** | (2006.01) |
| ***A42B 3/22*** | (2006.01) |

(52) U.S. Cl.

CPC ..... *A41D 13/0025* (2013.01); *A41D 13/11* (2013.01); *A42B 3/0406* (2013.01); *A42B 3/22* (2013.01); *A42B 3/286* (2013.01)

(58) Field of Classification Search

CPC .. A41D 13/0025; A41D 13/11; A41D 13/015; A41D 13/018; A42B 3/0406; A42B 3/145; A42B 3/22; A42B 3/286; A42B 3/285; A42B 3/003; A62B 18/045; A62B 18/04; A62B 18/006; A62B 18/00

USPC .... 2/424, 171.3, 419, 420, 15, 6.7, 8.2, 422; 128/201.25

See application file for complete search history.

(56) References Cited

U.S. PATENT DOCUMENTS

| | | | | |
|---|---|---|---|---|
| 2,504,979 A * | 4/1950 | Hornsby, Jr. | ..... | A42B 3/14 2/419 |
| 3,535,706 A * | 10/1970 | Aileo | ..... | A42B 3/003 2/5 |
| 4,901,716 A | 2/1990 | Stackhouse et al. | | |
| 5,009,225 A | 4/1991 | Vrabel | | |
| 5,046,492 A | 9/1991 | Stackhouse et al. | | |

(Continued)

*Primary Examiner* — Nathan E Durham
*Assistant Examiner* — Abby M Spatz
(74) *Attorney, Agent, or Firm* — Lucas & Mercanti, LLP

(57) ABSTRACT

A protection device (1) shaped like a helmet, apt to be worn on by a health operator during surgery, comprising: —a main body (2) shaped as a helmet shielding the operator's head, which main body (2) is worn on jointly to a lens (200); and—means (3) for forced circulation of air in an internal environment (20) accommodating the operator's head and defined by said main body (2) and by the associated vision element (200), which forced circulation means (3) comprises air inletting means (31) and air suction means (32), the latter apt to cause an evacuation of exhausted air from the environment (20) accommodating the subject's head.

20 Claims, 7 Drawing Sheets

(56) References Cited

U.S. PATENT DOCUMENTS

| | | | | |
|---|---|---|---|---|
| 5,054,480 | A * | 10/1991 | Bare | A41D 13/11<br>128/201.25 |
| 5,592,936 | A | 1/1997 | Thomas, Jr. et al. | |
| 5,887,281 | A | 3/1999 | Green et al. | |
| 6,081,929 | A * | 7/2000 | Rothrock | A42B 3/286<br>2/171.3 |
| 2006/0225187 | A1* | 10/2006 | Wu | A42B 3/145<br>2/425 |
| 2007/0113318 | A1* | 5/2007 | Weston | A42B 3/281<br>2/171.3 |
| 2008/0092279 | A1* | 4/2008 | Chiang | A42B 3/324<br>2/425 |
| 2009/0083900 | A1* | 4/2009 | Wallace | A42B 3/227<br>2/424 |
| 2009/0151054 | A1* | 6/2009 | VanDerWoude | A41D 13/1153<br>2/410 |
| 2010/0095439 | A1* | 4/2010 | Nolan | A42B 3/24<br>2/421 |

* cited by examiner

SURGICAL HELMET

FIELD OF THE INVENTION

The present invention refers to a protection device adapted to be worn by a health operator, typically a surgeon, during surgery, and in particular to a device substantially in the form of a helmet.

BACKGROUND OF THE INVENTION

Over the last two decades, protection systems for protecting a health operator's head and face based on a helmet to be worn during surgery have become of widespread use. Traditionally, such systems are mainly formed just by a helmet, a cap or a protection gown covering the helmet, by a lens i.e., a transparent splash guard visor constrained to the cap or gown, by a drive unit and a related power-supplying battery. As mentioned, the system is worn by the health operator during surgery.

These systems are especially used in orthopedic surgery, with specific reference to surgery for implanting knee and hip prostheses, in which drills provided with reamers and saws are used. In that sense, helmets have proven to be superior protection to that afforded by masks and common face protection shields, as a helmet covers the entire head of the health operator, creating a sterile barrier between the health operator and the patient. Such a barrier protects the operator from the considerable amount of possibly contaminated blood spurts emitted in the course of surgery.

Moreover, the helmet generally comprises a fan for air circulation inside the environment accommodating the surgeon's head. Such air circulation opposes perspiration and contributes to keeping the air inside the facial chamber cool, thereby increasing the operator's comfort level.

In addition, air circulation also offers a valid protection against the so-called "aerosol effect" of virus-contaminated particles. Potential infection risks for the surgeon associated with the aerosol effect and benefits from the use of surgical helmets are amply demonstrated in literature (see, e.g.: Jonathan A. Eandi et al., "Use of a surgical helmet system to minimize splash injury during percutaneous renal surgery in high-risk patients," *Journal of Endourology*, Vol. 22, No. 12, December 2008).

Moreover, the above-mentioned systems offer protection for the patient as well, with respect to contaminations coming from the surgeon and other health operators, e.g., hair, dandruff and saliva droplets, and therefore the possibility of wound infection. Infection rates described in literature are between 0.38% and 2% for THA (Total Hip Arthroplasty) and between 0.77% and 4% for TKA (Total Knee Arthroplasty), with data increasing in the course of revision surgery.

Therefore, for all purposes the above-mentioned protection system based on a surgical helmet may be deemed to be both a medical device, owing to the protection offered to the patient, and an individual protection device for the health operator.

Main Drawbacks of Known Art

The above-described known protection systems suffer from some relevant drawbacks.

First of all, a mere ventilation of the head-accommodating environment is useless to prevent carbon dioxide accumulation inside the same environment and does not effectively oppose the lens fogging phenomenon, related above all to the health operator's breathing. In connection with this latter aspect, the Inventors observed that only in the first stages of surgery, such fogging is reduced by means of fan-produced air circulation.

However, as time passes—a hip or knee prosthesis surgery can last up to several hours—besides fogging, the above-mentioned $CO_2$ accumulation occurs, which may cause queasiness. In fact, the cap or robe associated with the helmet may "seal" the environment at the neck level, allowing no adequate $CO_2$ evacuation below the helmet.

To this end, it should be noted that for the manufacturing of the robe or cap, the evolution of the field leads to the use of repellent materials, in particular polypropylene ones, preventing perspiration.

Moreover, the known systems have remarkable weights and encumbrances even at the level of the sole helmet (which is then to be associated to lens, motor and battery), penalizing the health operator's comfort at the head level and accordingly limiting his/her body motions.

Furthermore, in the known systems the cap-lens unit is kept in position on the helmet by Velcro® arranged on the lens and on the stationary structure of the helmet. This complicates the undressing modes of the health operator, who should separate the coupled strips by tearing them off, and may result in inaccuracy in the position of the entire protection system, and specifically of the lens in the dressing stage, since the strips may adhere accidentally according to a coupling configuration different from the desired one.

SUMMARY OF THE INVENTION

Therefore, the technical problem set and solved by the present invention is that of providing a protection system wearable by a health operator during surgery that overcomes the drawbacks mentioned above with reference to the known art.

Such a problem is solved by a protection device and protection system as defined in the claims.

The present invention provides a number of relevant advantages. The main advantage lies in the fact that the presence of air suction means operating within the environment accommodating the health operator's head allows an evacuation of exhausted air from such environment, preventing $CO_2$ accumulation therein.

The suction means also allows a drastic reduction of the lens fogging phenomenon for the entire duration of the surgery.

Preferred features of the present invention are set forth in the appended claims.

In particular, according to a particularly preferred feature, the device of the invention comprises a helmet formed by structural members having a tubular configuration, i.e., an internally hollow profile.

This allows attainment of a maximization of the weight/use ratio of the support structure, increasing the surgeon's comfort and therefore the safety of the surgery. Moreover, such structural members are apt to perform a function of guiding or piping the air flow generated by the suction means.

Moreover, according to another particularly preferred feature, coupling flanges are provided, obtained on the helmet, to the ends of a direct connection between the latter and the garment (cap, gown, robe, etc.) associated to the vision lens.

Other advantages, features, and the operation steps of the present invention will be made apparent in the following detailed description of some embodiments thereof, given by way of example and not for limiting purposes.

BRIEF DESCRIPTION OF THE FIGURES

Reference will be made to the figures of the annexed drawings, wherein.

DETAILED DESCRIPTION OF PREFERRED EMBODIMENTS

Figure 1A:
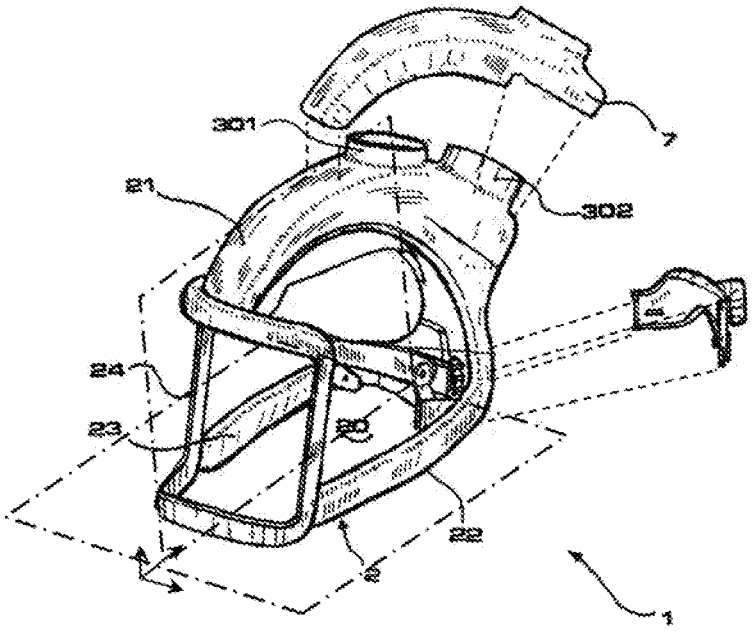
FIGS. 1A, 1B and 1C refer to a first preferred embodiment of the protection device according to the present invention, respectively showing a front perspective view, a longitudinal section view and a bottom plan view thereof.

Referring initially to FIGS. 1A, 1B, 1C and 1D, a protection device adapted to be worn by a health operator, typically a surgeon, during surgery, according to a first preferred embodiment of the invention, is generally denoted by 1.

The device 1 has a main body 2 substantially shaped as a helmet and apt to surround the health operator's head. Therefore, for simplicity's sake hereinafter, the device 1 also can be referred to as surgical helmet.

The main body 2 has a load-bearing structure made with longitudinal and transversal members integral with each other and lightening (weight reducing) compartments interposed thereamong. In particular, the main body 2 has a longitudinal upright structural member 21 of curved shape which substantially follows the profile of the operator's head along the sagittal plane. The longitudinal upright 21 is joined at a bottom end thereof, substantially in the occipital rear region of the skull, with a pair of lateral structural members 22 and 23. The members 22, 23 extend just laterally to the head, following its contour in an anteroposterior direction, therefore also developing along a curved profile of the head and defining a bottom part of the main body 2.

The lateral structural members 22 and 23 are frontally joined to a further front structural member 24 shaped substantially like a polygonal mask, and in particular substantially rectangular. Such mask-like structural member 24 is joined topwise to the other (front) end of the longitudinal upright 21. The front mask 24 defines a central opening adapted to be closed by a transparent vision element, or lens, 200, which, when worn, is joined to the helmet 1 as will be described hereinafter.

The surgical helmet 1 further comprises means for forced circulation of air, generally denoted by 3, in an environment, denoted by 20, housing the surgeon's head and defined and externally closed by the main body 2, by the above-mentioned lens 200 and a garment like a cap, robe, gown or the like, to which the lens itself is attached, and that will also be described hereinafter.

In the present example, the means 3 for forced circulation of air comprises a first and a second ventilation means, respectively 31 and 32, typically implemented by axial or radial blowers of a type known per se and housed at an internal portion of the longitudinal upright 21. Such first and second ventilation means 31 and 32 are associated with power supply means, e.g. batteries, not shown in the figures and optionally arranged in a remote position with respect to the main body 2.

The first ventilation means 31 is a means for delivering "fresh" air into the environment 20. According to the invention, the second ventilation means 32 is instead a means for the suction of exhausted air from the environment 20, hence allowing an evacuation of exhausted air from the environment and, therefore, a reduction in $CO_2$ content.

On the external part of the upright 21, the forced circulation means 3 provide a pair of projections in the form of coupling flanges, each located at a respective inlet means 31 or suction means 32 and in turn respectively denoted by 301 and 302.

Figure 2:
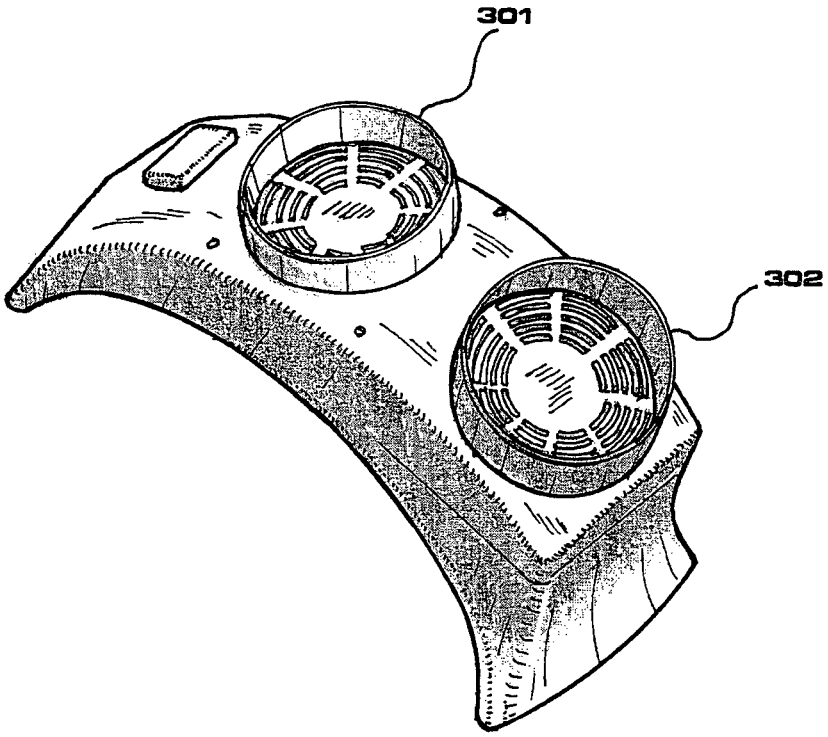
FIG. 2 shows a top perspective view of a component of the device of FIG. 1A.

As best seen in FIG. 2, the ventilation means 31, 32 and the related coupling flanges 301, 302 are arranged longitudinally side-by-side in pairs on the upright 21.

As will also be illustrated hereinafter, the flanges 301 and 302 are suitable to allow a direct connection between the surgical helmet 1 and the garment (cap, gown, robe, etc.) associated to the vision lens 200.

In the present example, the coupling flanges 301 and 302 are in the form of hollow cylindrical members.

A variant embodiment envisioned may be one or both of the active ventilation means 31 and 32 to be at least partially placed in a remote position with respect to the main body 2 and in fluid communication with the internal environment 20. Such communication may be established at vents or sleeves associated with or on the main body 2 and identifiable also with the same flanges 301 and 302. Such fluid communication may be implemented by pipes, connectors or equivalent members known per se and preferably of snap coupling type on the vents themselves.

Moreover, always according to variant embodiments, one or both of the above-mentioned ventilation means 31 and 32 and their components may also be optionally at least partially carried by the health operator, e.g. at his/her waist, as will be illustrated hereinafter in connection with the embodiment shown in FIG. 7.

According to another variant embodiment, a single ventilation means may be provided, adapted to alternatively act as air inlet means and as air suction means during the same surgery, by periodically inverting its operation modes.

Referring again to the embodiment of FIGS. 1A-1D and 2, preferably, control means is provided for controlling the flow rate and/or the velocity of air inlet and/or exhaust by the ventilation means 31 and 32. In the present example such control means is embedded in a control unit 9, preferably positioned at an apical portion of the upright 21, forward to the ventilation means 31, 32. Preferably, the control unit 9 provides a sequential logic of operation.

Figure 1B:
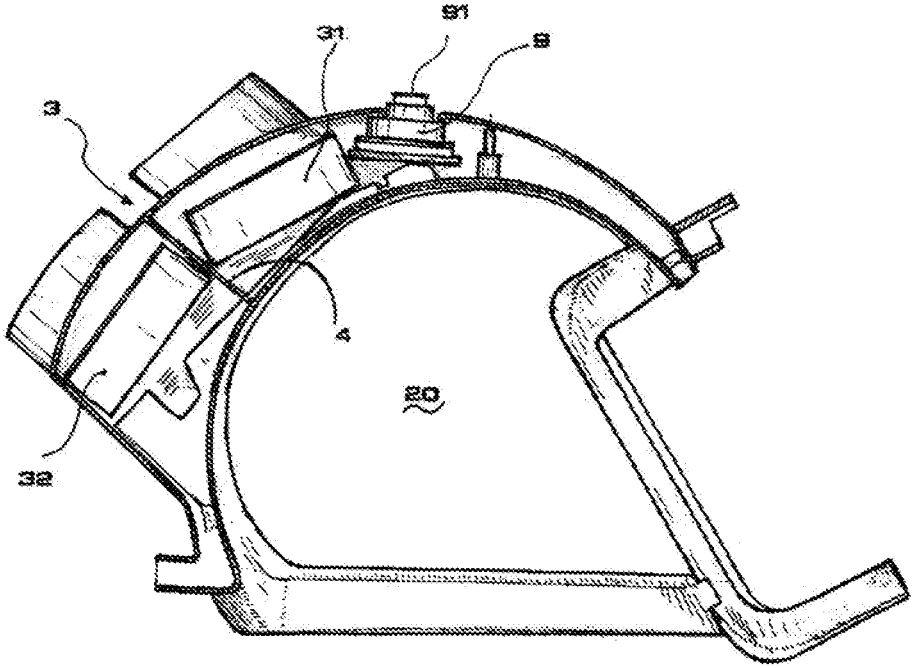

Advantageously, and as best seen in FIG. 1B, the control unit 9 comprises a top actuation element 91, e.g. a pushbutton, or a slidable or rotatable slider. The arrangement described is such that said actuation element 91 is in an ergonomic position easily accessible by the operator or his/her collaborators, even at the dressing stage.

Figure 1C:
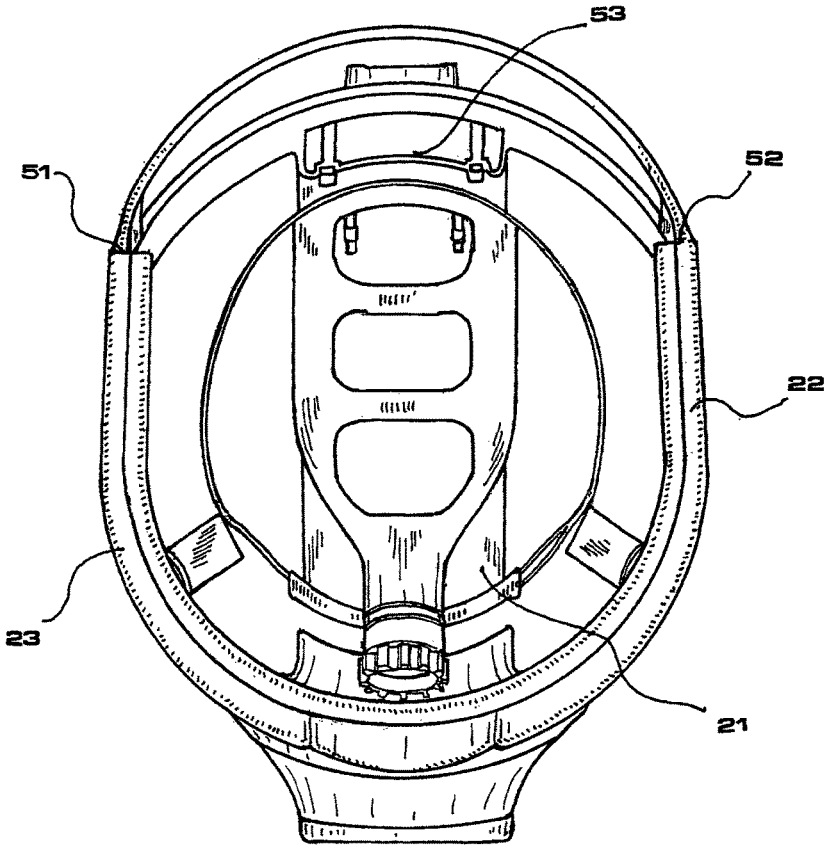

As best seen in FIG. 1C, to foster forced air circulation inside the environment 20, the load-bearing structural members 21, 22 and 23 defining the main body 2 preferably have a tubular configuration, in the sense of being internally hollow, and are in communication with each other. Thus, they are apt to guide the air flow generated by the forced circulation means 3. The lateral structural members 22 and 23 are in communication with the environment 20, each by a respective front opening or slit 51 and, whereas the longitudinal upright structural member 21 is in communication with environment 20 at its own front opening or slit 53. Moreover, the lateral members 22 and 23 are in communication therebetween and with the longitudinal upright 21 at a rear base of the latter. Therefore, such members 21, 22 and 23 define one or more chambers, internal to the main body 2 and are adapted to allow air circulation therein and in the environment 20, as will be detailed hereinafter.

As already described, the above-mentioned hollow configuration also causes a remarkable reduction in weight of the helmet 1.

Figure 1D:
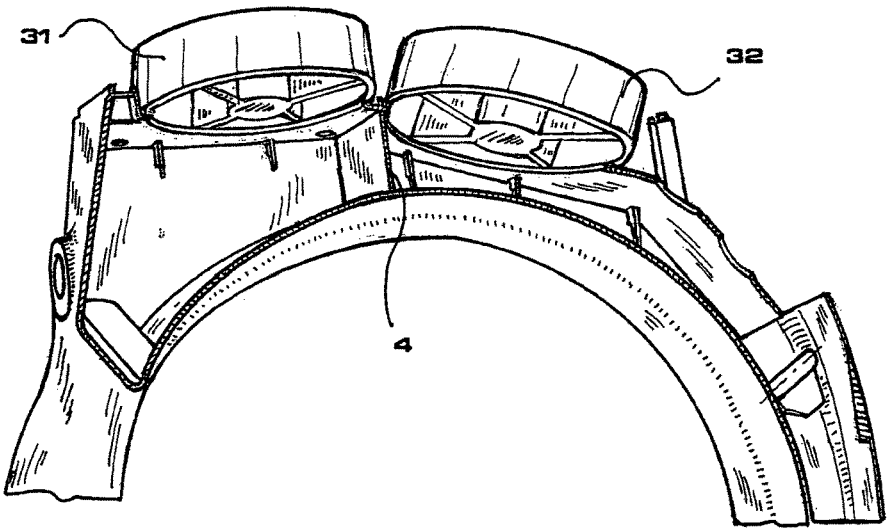
FIG. 1D shows a partially sectional side perspective view of a top portion of the device of FIG. 1A.

In order to make the removal of exhausted air from the environment 20 more effective, and as best seen in FIG. 1D, a bulkhead 4 is positioned within the longitudinal upright 21, and in particular interposed between the two ventilation means 31 and 32 so as to partition the internal portion of the main body 2 into two chambers for air circulation. In the present example, the bulkhead 4 is substantially in the form of a transverse baffle.

As mentioned herein, the bulkhead 4 permits partitioning of the compartment internal to the main body 2 into two chambers, and accordingly a partitioning of the environment 20 into two distinct regions, respectively a delivery region in direct communication with the inlet means 31 and a suction region in direct communication with the suction means 32.

Therefore, the overall configuration obtained with the arrangement of the ventilation means 31 and 32, the bulkhead 4 and the openings 51-53 is such that air is delivered inside the environment 20 by the means 31 and through the longitudinal upright 21 and the front opening 53 of the latter, and then conveyed toward the front zone defined by the mask 24. Suction through the means 32 occurs by the rear part of the longitudinal upright 21, the lateral structural members 22 and 23 and the openings 51 and 52 thereof. Thus, the compartment internal to the main body 2, and accordingly the environment 20, is substantially subdivided into a top chamber (delivery air) and a bottom chamber (suction air).

It will be appreciated that the placement of the opening or slit 53 of the longitudinal upright 21 directly at the lens 200 allows a controlled delivery of air directly on the lens, opposing in a maximally effective way its fogging.

Figure 3A:
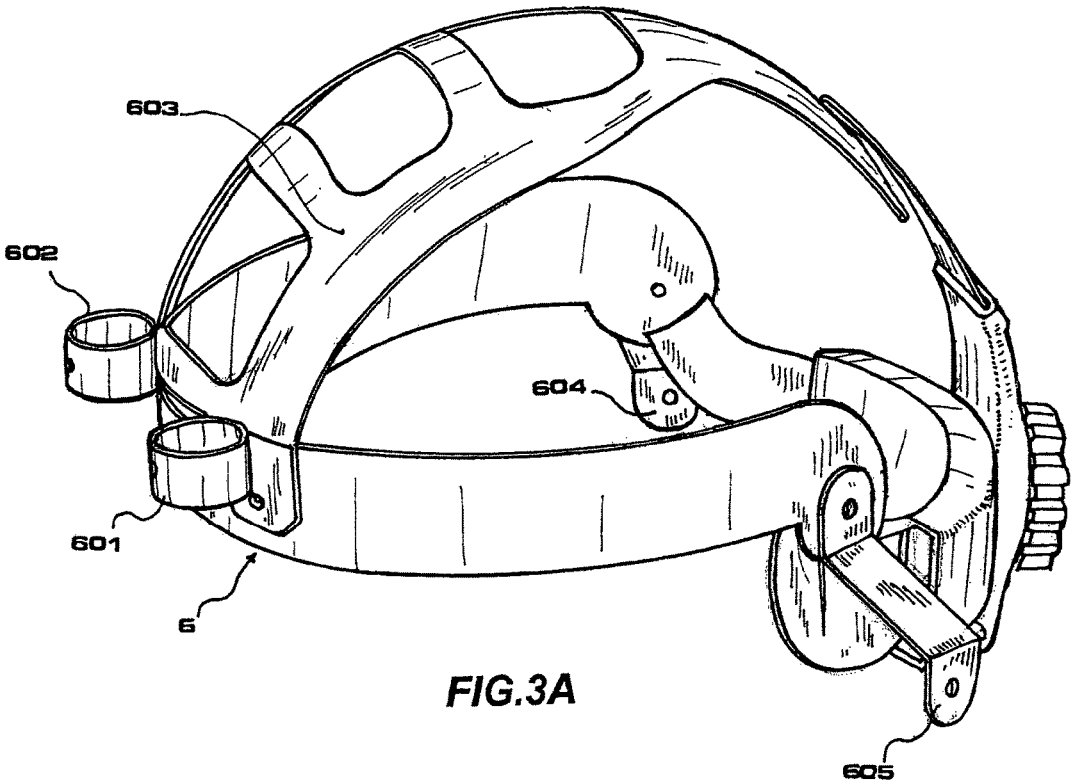
FIGS. 3A and 3B illustrate further internal components of the device of FIG. 1A, adapted to allow an adjustment of the position of the device itself on the operator's head, showing respectively a side perspective view and an exploded view thereof.
Figure 3B:
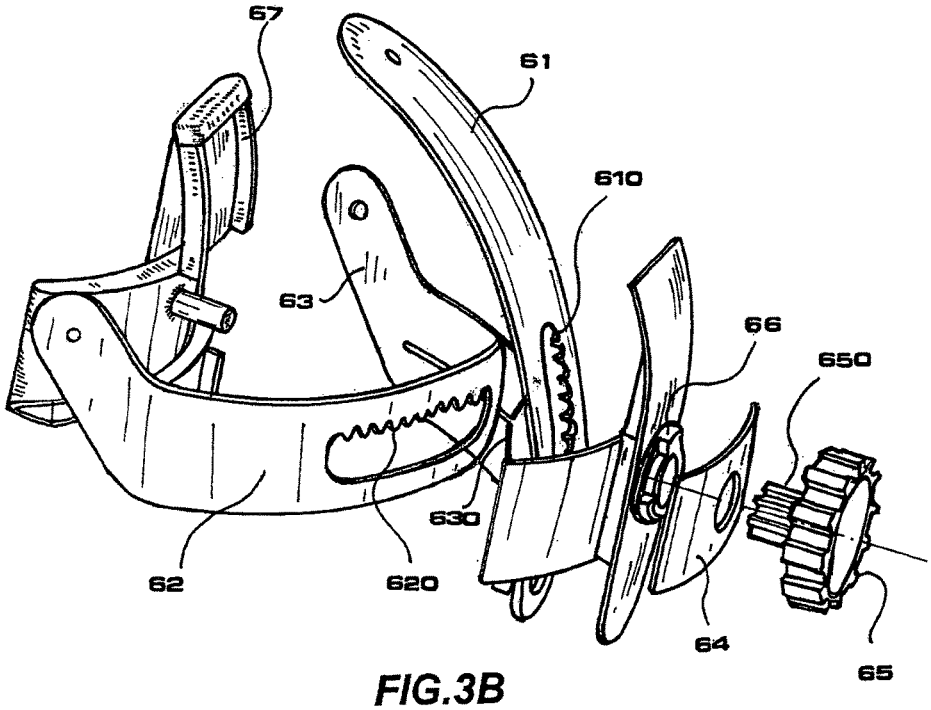

Referring now to FIGS. 3A and 3B, the helmet 1 comprises means for fitting the main body 2 on the operator's head, and in particular a substantially cap-shaped flexible structure 6 that, in use, is just interposed between the main body 2 and the head.

In particular, the structure 6 comprises a top member 603 which preferably provides a double curvature (spherical and elliptical) for improved fitting to the subject's head.

The structure 6 further provides a longitudinal member 61 for azimuthal adjustment, equipped with a longitudinal toothing 610 or an equivalent engagement means, allowing adjustment of the longitudinal (azimuthal) position of the main body 2 with respect to the health operator's head.

The structure 6 further comprises a pair of circumferential adjustment members, and in particular a left-side member 62 and a right-side member 63, each equipped with a transversal toothing 620, 630 substantially orthogonal, in use, to the longitudinal toothing 610, or with equivalent engagement means. The elements 62 and 63 allow an adjustment of the extension of the base circumference, just to allow the fitting of the helmet 1 to the specific anthropometry of the subject wearing it.

This twin adjustment option for positioning the surgical helmet 1 on the head increases the stability, in use, of the helmet itself and greatly improves the operator's comfort.

Advantageously, both the circumferential and the azimuthal adjustments are obtainable by a single knob 65, or an equivalent adjustment means, arranged, in use, at the occipital portion of the skull, and equipped with a toothed spindle 650 engaging, in use, the toothings 610 and 620, 630. The spindle 650 may be made with a single module and pitch or with a double module and pitch.

The knob 65 is coupled to the toothings 610 and 620, 630 just by the toothing of the spindle 650. Moreover, partitioning member 64 is interposed, operating a partition and allowing a sliding between the azimuthal and circumferential adjustment members 61 and 62, 63. The partitioning member 64 is equipped with a through hole that is crossed by the toothed spindle 650. Moreover, an elastic arresting member 66 is provided between toothings 610 and 620, 630 and knob 65, that carries out the arresting and the keeping of the desired position, preventing a further sliding of the toothings 610 and 620, 630 on the spindle 650. Such elastic member 66 may provide an axial bending or a circumferential bending and be made, e.g., of plastics.

To the ends of adjustment, the knob 65 is merely rotated to the desired level of azimuthal and circumferential adherence of the structure 6 to the head.

The structure 6 is connected to the main body 2 at selected points, in particular in the present example in correspondence of two front connection members 601 and 602 and two rear connection members 604 and 605. Furthermore, the structure 6 is completed by a front member 67 inside which the front portion of the azimuthal adjustment member 61 and the two circumferential adjustment members 62 and 63 engage.

It will be appreciated that the heretofore-described surgical helmet 1 is particularly susceptible of a modular construction.

For this purpose, in FIG. 1A, a shield or partializing member 7 is depicted and is adapted to be constrained, preferably removably, to the main body 2 at the longitudinal upright 21 thereof, so as to exclude the air inlet means 31. In such a configuration, inside the environment 20 a forced air circulation is provided, associated just to the sole suction operated by the means 32.

Figure 4A:
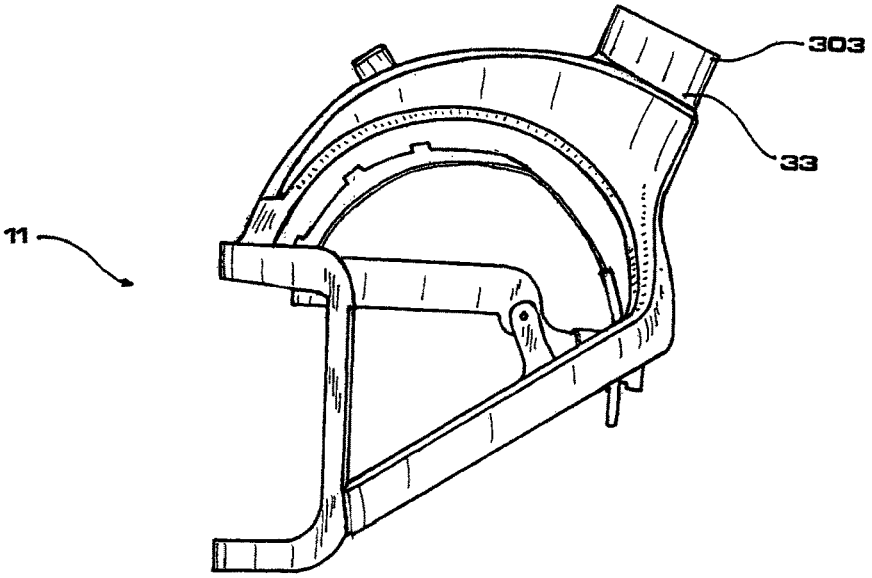
FIGS. 4A and 4B illustrate a second preferred embodiment of the protection device according to the present invention, showing respectively a side view and a front view thereof.
Figure 4B:
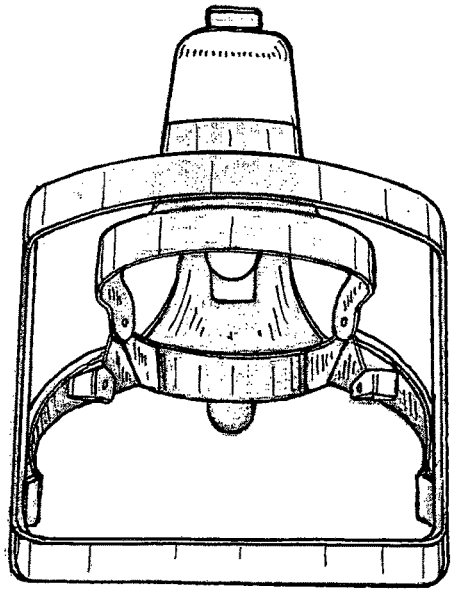

FIGS. 4A and 4B refer to a second preferred embodiment of the protection device or surgical helmet of the invention, in this case generally denoted by 11. The helmet 11 differs from the first embodiment described above only in that it provides a single ventilation means, denoted by 33 and arranged in this case as well at a longitudinal upright 21 of a main body 2.

As illustrated for a variant embodiment of the first embodiment, such ventilation means 33 may serve as sole forced air circulation member, or alternatively as an inlet and suction member.

Moreover, at the rear base of the main body 2, a bulkhead or an equivalent substitute member may be provided for separating the inlet air volume from the outlet one.

In this case as well, a variant embodiment may be provided in which the ventilation means 33 is entirely or partially placed in a remote position with respect to the main body 2 and in fluid communication with the environment 20 by a vent or sleeve, denoted herein by 303, on or associated with the main body 2.

Figure 5:
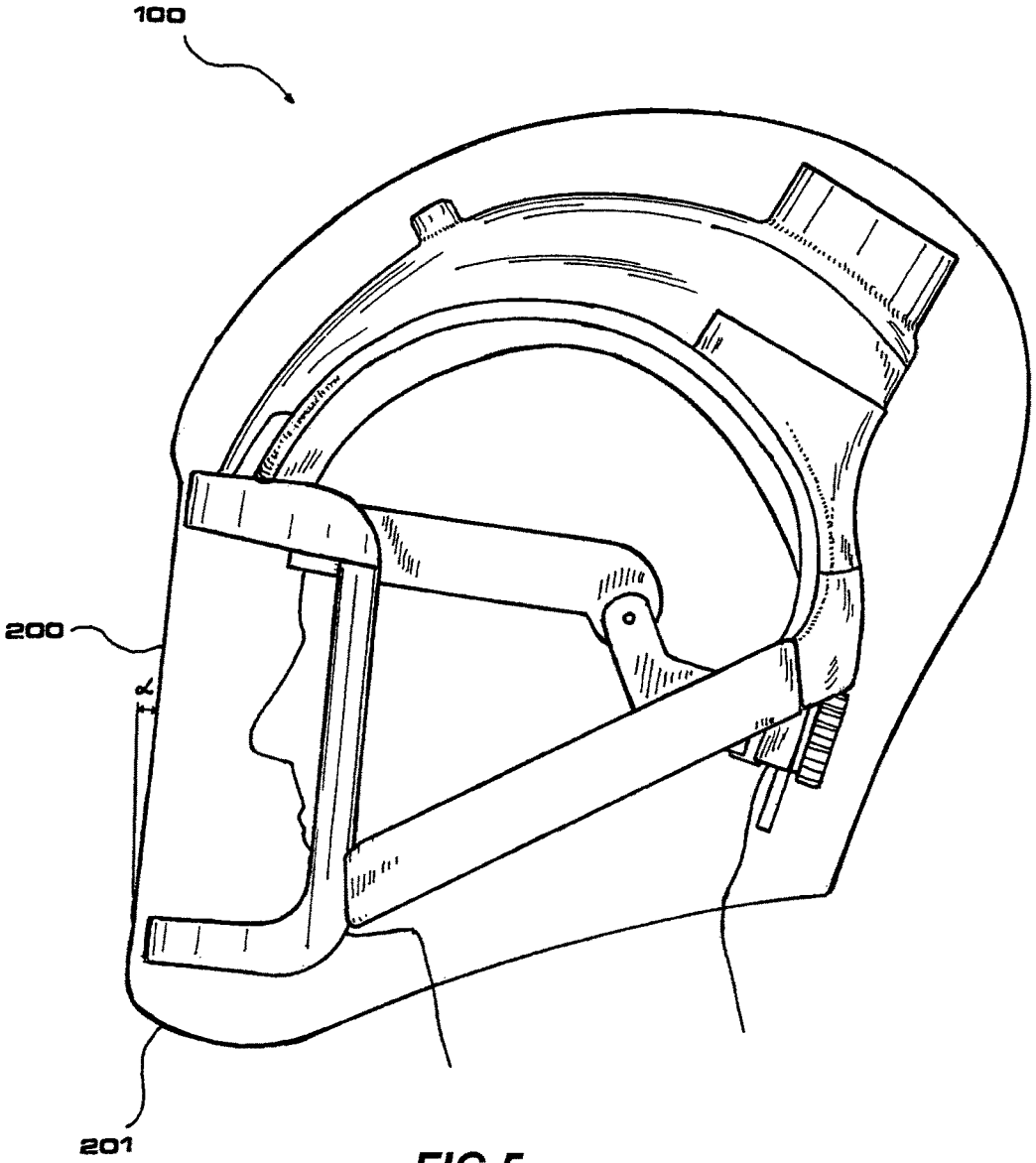
FIG. 5 shows a side view of a protection system incorporating the device of FIG. 4A worn by a health operator.

FIG. 5 shows the above-described protection device 11 worn by a health operator as part of a protection system 100 comprising also the lens 200 and the cap- or robe-type garment, denoted herein by 201, to which the lens itself is associated.

While FIG. 5 shows a surgical helmet 11 complying with the second embodiment, the description thereof, and in particular of the system 100, is also applicable in connection to the first embodiment of the protection device and any variant thereof, as well as in connection to the embodiments that will be described hereinafter.

Preferably, the lens 200 is removably constrainable to the main body 2 of the helmet 1, 11 by Velcro® strips, magnetic members or equivalent means arranged in selected positions on the same helmet and lens. In use, the lens 200 is arranged abutted onto the front mask 24 of the main body 2. Preferably, the overall arrangement is such that, in said operating configuration, the lens is tilted toward the subject with respect to the virtual vertical passing by the base of the main body 2 (or chin guard) according to an angle $\alpha$, preferably n a range of about 3-8 degrees.

Moreover, preferably additional removable connection means are provided to constrain the main body 2 to the garment 201. Advantageously—and as already described above—in the present example, such additional means are based on a shape coupling between the connection flanges 301, 302 or 303 of the main body 2, and corresponding complementary members associated the garment 201. In the present example, these latter members are in the form of a circular crown.

Figure 6:
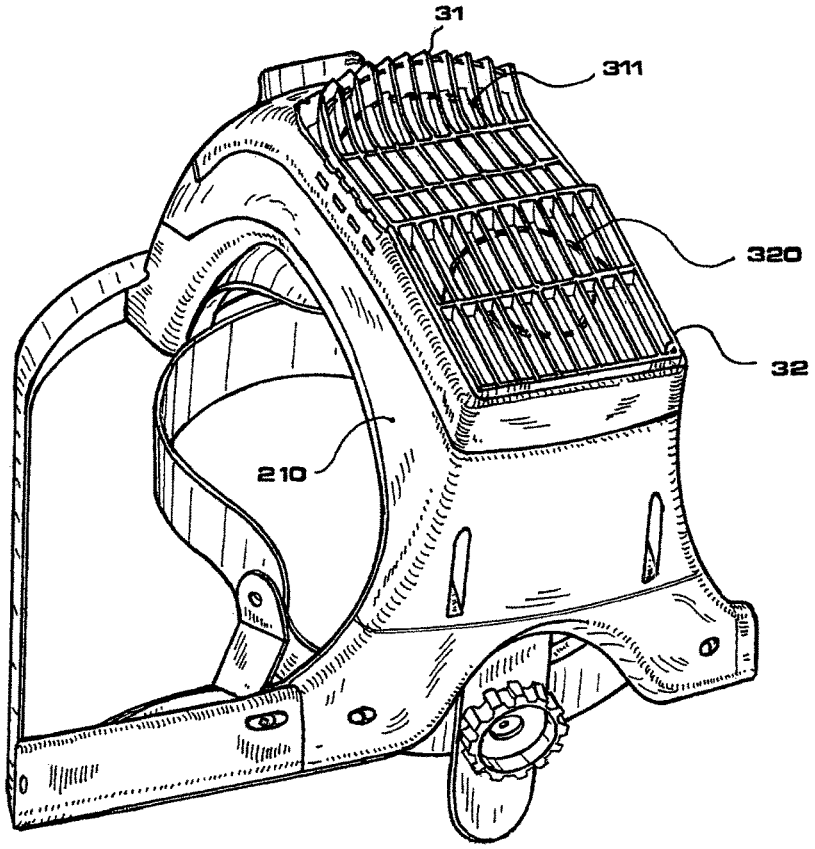
FIG. 6 illustrates a third preferred embodiment of the protection device according to the present invention, showing a rear perspective view thereof.

FIG. 6 refers to a third embodiment of the surgical helmet of the present invention, which will be described only in connection with the aspects differentiating it from the above-described embodiments and variants.

The difference is associated to the different configurations of the housings receiving the first and second ventilation means, here as well designated by 31 and 32. In particular, at the level of the inlet means 31 is provided the presence of a recess 311 in the profile of the top upright, denoted herein by 210, with the aim of making a sort of air tank or reservoir between the cap or the like covering the helmet and the blower or equivalent means implementing the means 31, and to this end, an improvement of the efficiency of the latter.

Instead, at the level of the suction means 32, a substantially flat profile 320 is provided, to guarantee adherence between filter and blower discharge.

Figure 7:
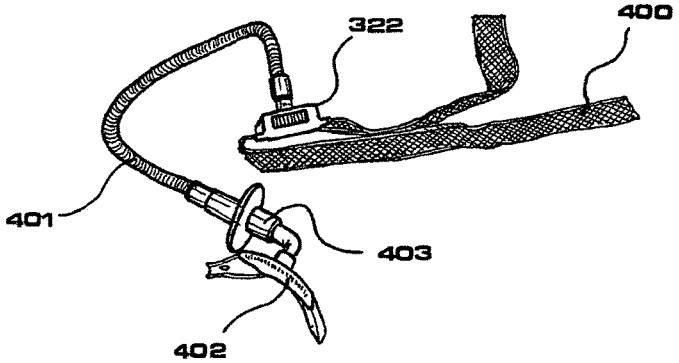
FIG. 7 illustrates a fourth preferred embodiment of the protection device according to the present invention, showing a perspective view of some specific components thereof.

FIG. 7 shows a fourth embodiment of the surgical helmet of the present invention, which in this case as well will be described merely in connection with the aspects differentiating it from the above-considered embodiments and variants. As already explained, in this case the forced circulation means is at least partially housed in a remote position and in particular at the subject's waist by a belt 400. A tube-type or equivalent connector 15 is provided, which sets in fluid communication the suction means, denoted herein by 322, generating the flow of air under suction with the internal chamber of the main body 2.

Moreover, a coupling member 402 in the form of a connector or the like is provided between pipe 401 and main body 2. Preferably, the member 402 is of removable and interchangeable type, also in order to allow operation with the sole delivery (inlet) air for the surgical helmet, in that sense guaranteeing the full modularity and versatility of use of the system.

In the present example, the insertion of a filtering member 403 for virus and bacteria is also provided, interposed between connecting element 402 and tube 401. Various embodiments may provide that one or more of such filtering members be (also) applied at the level of the above-introduced bushings or flanges of the main body. Integration of such filtering members on the helmet may occur also with the insertion of filtering pockets and/or pleated filters.

Moreover, the remote placement of part of the forced circulation means may also be carried out, e.g., at the level of the shoulders—with a schoolbag-type configuration—or in a different position.

By now, it will be better appreciated that each of the above-described embodiments, variants and configurations allows an optimal conveying and evacuation of the exhausted air from the environment accommodating the operator's head toward the outside, with significant benefits associated with the operator's comfort and to his/her improved vision of the operating field.

Moreover, it will be appreciated that the proposed system is predisposed to a modular construction, thereby enabling the health operator to choose a solution customized and subjectively best for him/herself, guaranteeing head comfort and freedom of body motions.

Such modularity also allows, at the production stage, to employ the same structural members described above with reference to the main body of the helmet for making devices equipped with single or double inlet delivery and/or single or double suction means, employing in that sense the same stationary frame to incorporate different ventilation means.

It will also be better appreciated that the lightness of the helmet is guaranteed by the presence of a load-bearing structure with the above-mentioned piping function, wherein each structural volume is hollow and utilized for conveying air under delivery and under suction.

Finally, it has to be noted that for the additional feature related to the presence of removable connection means between the main body and a lens bearing garment as defined in the dependent claims and as described above, a protection independent of the presence of the means for forced circulation of air of which at the independent claim might be sought.

Likewise, a separate protection, independent of the presence of the air suction means, might be sought for the piping-type embodiment of the load-bearing structural members forming the main body, as defined in the claims and as described above.

The present invention has been hereto described with reference to preferred embodiments thereof. It is understood that other embodiments might exist, all falling within the concept of the same invention, and all comprised within the protective scope of the claims hereinafter.

The invention claimed is:

1. A surgical helmet configured to be worn by a health operator during surgery, comprising: a main body configured to surround the health operator's head, said main body having a top, a bottom, opposing sides and an interior cavity configured to receive the health operator's head; and a forced circulation device, configured for forced circulation of air in an environment, wherein the environment is configured to accommodate the health operator's head and defined by said main body and by a transparent vision element worn by the health operator, wherein said forced circulation device comprises an air suction component, configured to cause an evacuation of exhausted air from said environment, and an air inlet component configured for delivering air to said environment, wherein said main body is formed by a load-bearing structure comprising a plurality of tubular members defining the interior cavity and an air circulation circuit for circulating air, said plurality of tubular members being configured to guide an air flow generated by said forced circulation device entering into or exiting from said environment, wherein said air suction component and said air inlet component are arranged longitudinally side-by-side at an apical portion of said main body along a sagittal plane of the surgical helmet, wherein said forced circulation device comprises one or more partitioning bulkheads disposed within said plurality of tubular members and configured to partition said air circulation circuit into a top delivery chamber and a bottom suction chamber, wherein said plurality of tubular members comprise two oppositely-positioned, bottom transversal members defining said bottom of said main body and extending from a top structural member being a longitudinal upright member defining said top of said main body, wherein said two oppositely-positioned bottom transversal members extend along a transverse plane and said longitudinal upright member extends along a longitudinal plane which is orthogonal to said transverse plane, said two oppositely-positioned bottom transversal members and said longitudinal upright member defining oppositely-positioned apertures extending from said two oppositely-positioned bottom transversal members to said longitudinal upright member in said opposing sides of said main body providing access to said interior cavity, and wherein said forced circulation device delivers air into the environment through a front opening of said top structural member and suctions air from said environment through openings of said two oppositely-positioned bottom transversal members.

2. The surgical helmet according to claim 1, wherein said air suction component is at least partially housed within said main body.

3. The surgical helmet according to claim 1, wherein said air suction component is housed inside one of the plurality of tubular members of said main body.

4. The surgical helmet according to claim 1, wherein said forced circulation device comprises a connecting element configured to allow said air suction component to be at least partially positionable in a separate position with respect to said main body.

5. The surgical helmet according to claim 4, wherein said connecting element is arranged at a top portion of said main body.

6. The surgical helmet according to claim 1, wherein said one or more partitioning bulkheads is arranged at a top portion of said main body.

7. The surgical helmet according to claim 1, wherein said forced circulation device comprises one or more openings for delivery or suction of air, wherein the one or more openings are arranged at a side or front portion of said main body.

8. The surgical helmet according to claim 7, wherein one or more of said one or more openings are arranged at a chin guard portion of said main body.

9. The surgical helmet according to claim 1, further comprising a control device for controlling at least one of, a flow rate, and a velocity of air exhausted or delivered by said forced circulation device.

10. The surgical helmet according to claim 1, further comprising a connection component configured for connection to a removable garment, wherein the connection component is arranged at a top portion of said main body.

11. The surgical helmet according to claim 10, wherein said connection component is in the form of one or more shaped connection flanges.

12. The surgical helmet according to claim 10, wherein one or more virus- or bacteria-filtrating elements are provided, applied at said connection component.

13. The surgical helmet according to claim 1, further comprising an adjustment element configured for adjusting a longitudinal position of said main body on the health operator's head.

14. The surgical helmet according to claim 1, further comprising an adjustment element configured for adjusting a circumferential position of said main body on the health operator's head.

15. The surgical helmet according to claim 14, wherein said adjustment element comprises a single knob configured for simultaneously adjusting the circumferential position and a longitudinal position of said main body on the health operator's head.

16. The surgical helmet according to claim 15, wherein said single knob is arranged at an occipital region of the surgical helmet.

17. The surgical helmet according to claim 1, further comprising a magnetic securing device configured for securing said main body to the vision element.

18. The surgical helmet according to claim 1, wherein said air suction component is housed in the longitudinal upright member wherein said longitudinal upright member develops along a sagittal plane of the surgical helmet.

19. A surgical helmet configured to be worn by a health operator during surgery, comprising: a main body configured to surround the health operator's head, said main body having a top, a bottom, opposing sides and an interior cavity configured to receive the health operator's head; and a forced circulation device, configured for forced circulation of air in an environment, wherein the environment is configured to accommodate the health operator's head and defined by said main body and by a transparent vision element worn by the health operator, wherein said forced circulation device comprises an air suction component configured to cause an evacuation of exhausted air from said environment, and an air inlet component configured for delivering air to said environment, wherein said main body is formed by a load-bearing structure comprising a plurality of tubular members defining the interior cavity and an internal circulation circuit of air, said plurality of tubular members being configured to guide an air flow generated by said forced circulation device entering into or exiting from said environment, wherein said plurality of tubular members comprise a top longitudinal tubular member of curved shape defining said top of said main body and configured to follow the profile of the health operator's head along a sagittal plane, and a pair of oppositely-positioned, bottom lateral tubular members, each joined to a bottom end of the top, longitudinal tubular member, said pair of oppositely-positioned bottom lateral tubular members defining said bottom of said main body and being configured to extend laterally along the health operator's head, wherein said pair of oppositely-positioned bottom lateral tubular members extend along a transverse plane and said top longitudinal tubular member extends along a longitudinal plane which is orthogonal to said transverse plane, said pair of bottom lateral tubular members and said top longitudinal tubular member defining oppositely-positioned apertures extending from said pair of oppositely-positioned bottom lateral tubular members to said top longitudinal tubular member in said opposing sides of said main body providing access to said interior cavity, wherein said air suction component and air inlet component are arranged longitudinally side-by-side at an apical portion of said main body along said sagittal plane, wherein said forced circulation device comprises a bathe disposed within said plurality of tubular members and configured to partition said air circulation circuit into a top delivery chamber and a bottom suction chamber, and wherein said forced circulation device delivers air into the environment through a front opening of said top longitudinal tubular member and suctions air from said environment through openings of said pair of bottom lateral tubular members.

20. The protection system according to claim 19, wherein said transparent vision element, in use, is adapted to be tilted at an angle variable in a range of 3-8 degrees toward the health operator with respect to a vertical plane.

* * * * *